US010119289B2

(12) United States Patent
Kissell et al.

(10) Patent No.: US 10,119,289 B2
(45) Date of Patent: Nov. 6, 2018

(54) BATTEN BAR ASSEMBLY

(71) Applicant: HMT LLC, The Woodlands, TX (US)

(72) Inventors: John Randolph Kissell, Durham, NC (US); Satyajit Dilip Bagul, Tomball, TX (US)

(73) Assignee: HMT LLC, The Woodlands, TX (US)

( * ) Notice: Subject to any disclaimer, the term of this patent is extended or adjusted under 35 U.S.C. 154(b) by 0 days.

(21) Appl. No.: 14/962,921

(22) Filed: Dec. 8, 2015

(65) Prior Publication Data

US 2017/0159313 A1 Jun. 8, 2017

(51) Int. Cl.
*E04B 1/19* (2006.01)
*E04H 7/00* (2006.01)
(Continued)

(52) U.S. Cl.
CPC ..... *E04H 7/00* (2013.01); *E04B 1/1903* (2013.01); *E04B 1/3211* (2013.01); *E04B 1/58* (2013.01); *E04B 1/6116* (2013.01); *E04B 7/105* (2013.01); *E04H 7/065* (2013.01); *B65D 88/34* (2013.01); *B65D 90/06* (2013.01); *E04B 2001/1924* (2013.01); *E04B 2001/1975* (2013.01);
(Continued)

(58) Field of Classification Search
CPC ... E04H 7/065; E04D 2003/0806; E04D 3/08; E04D 2003/0893; E04D 2003/0856; E04D 2003/0868; E04B 1/3211; E04B 1/58; E04B 1/1903; E04B 1/6116; E04B 2001/1975; E04B 2001/3247
USPC ..... 52/463, 467, 81.3, 81.2, 81.1
See application file for complete search history.

(56) References Cited

U.S. PATENT DOCUMENTS 1,016,118 A * 1/1912 Wendler ..... E04D 3/08 52/395
3,158,961 A * 12/1964 Hawkins ..... E04D 3/08 52/200
(Continued)

FOREIGN PATENT DOCUMENTS

AT 514012 A2 * 9/2014 ..... E04C 3/02
EP 0208651 A1 1/1987
(Continued)

OTHER PUBLICATIONS

U.S. Appl. No. 14/088,137, filed Nov. 22, 2013, Christopher Andrew Blinn.
(Continued)

*Primary Examiner* — Babajide A Demuren
(74) *Attorney, Agent, or Firm* — Fletcher Yoder, P.C.

(57) ABSTRACT

A batten bar is configured to secure first and second adjacent flat panels to a structural framework. The batten bar includes first and second inside legs, first and second outside legs, and a plurality of apertures disposed along the length of the batten bar. The first and second inside legs define a central channel. The first outside leg and the first inside leg define a first seal recess configured to receive and retain a first seal. The second outside leg and the second inside leg define a second seal recess configured to receive and retain a second seal. In an installed configuration, the first inside leg and the first outside leg are configured to contact the first flat panel along a first common plane, and the second inside leg and second outside leg contact the second panel along a second common plane.

14 Claims, 10 Drawing Sheets

(51) Int. Cl.

| | |
|---|---|
| ***E04B 1/32*** | (2006.01) |
| ***E04B 1/58*** | (2006.01) |
| ***E04B 1/61*** | (2006.01) |
| ***E04B 7/10*** | (2006.01) |
| ***E04H 7/06*** | (2006.01) |
| *E04D 3/08* | (2006.01) |
| *B65D 88/34* | (2006.01) |
| *B65D 90/06* | (2006.01) |
| *E04H 7/22* | (2006.01) |

(52) U.S. Cl.
CPC ..... *E04B 2001/3247* (2013.01); *E04B 2001/3252* (2013.01); *E04B 2001/3294* (2013.01); *E04D 2003/0856* (2013.01); *E04H 7/22* (2013.01)

(56) References Cited

U.S. PATENT DOCUMENTS 3,462,893 A * 8/1969 Kaiser ..... E04B 1/3211 403/172
3,550,335 A * 12/1970 Huffman ..... E04B 7/102 52/200
3,791,088 A * 2/1974 Sandow ..... E04D 3/08 52/200
3,830,029 A * 8/1974 Vance ..... E04D 3/06 52/200
3,844,087 A * 10/1974 Schultz ..... E04D 3/08 52/200
3,909,994 A * 10/1975 Richter ..... E04B 1/3211 135/119
3,916,589 A * 11/1975 Richter ..... E04B 1/3211 52/464
3,999,336 A * 12/1976 Bance ..... E04B 1/3211 52/463
4,070,806 A * 1/1978 Hubbard ..... E04B 2/96 52/395
4,114,330 A * 9/1978 Sukolics ..... E04D 3/08 52/200
4,158,938 A * 6/1979 Meechan ..... E04B 1/12 52/309.11
4,297,825 A * 11/1981 Harper, Jr. ..... E04B 1/1903 52/463
4,418,506 A * 12/1983 Weber ..... E04B 2/967 52/204.593
4,455,798 A * 6/1984 Tsakiris ..... E04D 3/08 403/174
4,462,390 A * 7/1984 Holdridge ..... A01G 9/243 126/400
4,611,442 A * 9/1986 Richter ..... E04B 1/3211 52/467
4,621,472 A * 11/1986 Kloke ..... E04D 3/08 52/200
4,638,613 A * 1/1987 Tonsmann ..... E04B 1/24 52/200
4,680,905 A * 7/1987 Rockar ..... E04D 3/08 52/200
5,333,425 A * 8/1994 Nickerson ..... E04H 15/18 160/383
5,437,129 A * 8/1995 Konstantin ..... E04D 3/08 52/200
5,546,713 A * 8/1996 Voegele, Jr. ..... E04D 3/08 52/202
6,012,259 A * 1/2000 Hallsten ..... E04B 7/00 52/246
6,735,912 B2 * 5/2004 Riggio ..... E04D 3/08 52/235
7,143,550 B1 12/2006 Lopez
9,407,198 B2 * 8/2016 Shih ..... F24J 2/5207
2003/0079426 A1 5/2003 Riggio
2006/0156661 A1 * 7/2006 Ley ..... E04B 2/965 52/302.1

FOREIGN PATENT DOCUMENTS

GB 2422171 A 7/2006
JP H08312071 A 11/1996

OTHER PUBLICATIONS

Limelight International (HK) Co., Ltd; http://www.limelightpolycarbonate.com/sdp/998833/4/pd-4906201/7802713-2470336/aluminium_glazing_bar_aluminium_profile_polycarbon.html; Mar. 2010.
Sprung; http://www.sprung.com/building-components/aluminum-substructure; Oct. 2014.
International Search Report and Written Opinion for PCT Application No. PCT/US2016/065668 dated Feb. 28, 2017, 15 pgs.

* cited by examiner

BATTEN BAR ASSEMBLY

BACKGROUND

The present disclosure relates generally to the construction of dome roofs. More specifically, the present disclosure relates to improved batten bar assemblies for holding panels (e.g., dome roof panels) in place.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Above ground storage tanks are frequently used to store industrial quantities of a variety of raw and finished materials. These storage tanks may contain liquids, gases, solids, or some combination thereof and are used in a variety of industries. For example, the oil and gas industry frequently uses above ground storage tanks to store refined hydrocarbon products. Additionally, above ground storage tanks are also common in the petrochemical, pharmaceutical, cosmetics, food, and consumer products industries.

A variety of storage tanks may be used across all industries. For example, a storage tank may be cylindrically shaped with a fixed roof. The fixed roof, as opposed to an open top storage tank (e.g., a hopper), has the benefit of minimizing evaporation of liquid product in the tank. Moreover, a fixed roof limits contamination of the stored product by keeping foreign matter (e.g., water, dust, etc.) out of the tank. Fixed roofs come in a variety of configurations including flat, coned, umbrella, domed, etc. The roof shape may be based on the intended application of the storage tank. For example, a domed roof may be better suited for higher pressure applications because the curved structure typically distributes pressure better than a flat roof.

Storage tanks may also be equipped with floating roofs. A floating roof "rides" on the product stored inside the tank, reducing the evaporation of liquid product in the tank. Typically, a floating roof has seals between its edges and the walls of the storage tank. In some instances, floating roofs are used along with fixed roofs to provide two barriers between the environment and a stored product.

A dome roof is one of many different kinds of roofs that may be used on storage tanks. Dome roofs are typically self-supported, spherical segment frame structures. The frame is often created using a hub and spoke system, wherein geometric figures construct a segment of a spherical surface. The spokes can be at a variety of angles relative to the hub, as determined by the design, creating an opportunity for a variety of geometric shapes to construct the frame. Panels may be installed over the frame and may correspond to the shapes created by the frame. The panels may further overlap or nest into the underlying frame to create a continuous roof surface. In addition to storage tanks, other structures use dome roofs. For example, homes, entertainment arenas, and other commercial structures utilize dome roofs.

In some cases, domed roofs are created by overlapping adjacent panels and by fastening the adjacent panels to an underlying support beam (e.g., I-beam). In some cases, one or more edges of a panel may be folded or crimped to prevent slipping. In other cases, the panels may be nested into the underlying support beam. A batten bar may be placed on top of the overlapping portion and is fastened (e.g., with a bolt) in place to the support beam. For example, the fastener may extend through the batten bar, both panels, and into the support beam. In other embodiments, the batten bar may be placed over peripheral portions of adjacent nested panels, and the batten bar may be held in place by a fastener extending through the batten bar and into the support beam. A gasket surrounding the bolt hole may be included to seal the internals of the tank from the outside environment.

Current methods of dome roof construction have created several challenges for the industry. Fabrication and assembly may be expensive, time consuming, and result in excess scrap material. For example, embodiments that use a folded or crimpled panel may require additional labor and cost to fold the panels. Additionally, if the folded or crimped panel is designed interface with other components in the batten assembly (e.g., a batten bar or a beam), a tightening of tolerances for part fabrication and assembly may be required. Similarly, beams having an intricate and/or asymmetric design may be expensive to fabricate and further tighten the tolerances of the assembly. Furthermore, for designs in which a fastener is driven through one or more panels to secure the batten bar, the fastener must be driven "blind" without being able to see the corresponding hole or slot that engages the fastener.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In a first embodiment, a system includes a structural framework, first and second flat panels, a batten bar, and first and second seals. The structural framework includes a head having a substantially flat top surface and a first slot formed in the substantially flat top surface that extends a length of the structural framework. The first and second flat panels are supported by the structural framework and are substantially flat between outer edges of the respective panels. The batten bar is configured to secure the first and second panels to the structural framework. The batten bar includes first and second inside legs, first and second outside legs, and a plurality of apertures disposed along the length of the batten bar. The first and second inside legs define a central channel. The first outside leg and the first inside leg define a first seal recess configured to receive and retain the first seal. The second outside leg and the second inside leg define a second seal recess configured to receive and retain a second seal. The first and second seals are disposed within the first and second seal recess, respectively. In an installed configuration, the first and second flat panels are disposed on the substantially flat top surface of the structural framework, the batten bar and the first and second seals are disposed on top of the first and second panels such that the first inside leg and first outside leg contact the first panel along a first common plane, the second inside leg and second outside leg contact the second panel along a second common plane, and a plurality of fasteners extend through the plurality of apertures and engage with the first slot to hold the first and second panels in place.

In another embodiment, a system includes a batten bar configured to secure first and second adjacent flat panels to a structural framework. The batten bar includes first and second inside legs, first and second outside legs, and a plurality of apertures disposed along the length of the batten bar. The first and second inside legs define a central channel. The first outside leg and the first inside leg define a first seal recess configured to receive and retain a first seal. The second outside leg and the second inside leg define a second seal recess configured to receive and retain a second seal. In an installed configuration, the first inside leg and the first outside leg are configured to contact the first flat panel along a first common plane, and the second inside leg and second outside leg contact the second panel along a second common plane.

In a further embodiment, a method of securing a first and second panels to a structural framework, includes disposing first and second panels on a substantially flat top surface of the structural framework, wherein the first and second panels are substantially flat between outer edges of the respective panels, coupling first and second seals to a batten bar, comprising inserting first and second seal protrusions into respective first and second seal protrusion recesses in the batten bar, coupling the batten bar to the structural framework comprising aligning a plurality of apertures in the batten bar with a slot in the structural framework, inserting respective fasteners into each of the plurality of apertures, and engaging the fasteners with the slot to secure the first and second panels against the structural framework such that the batten bar contacts the first panel along parallel lines in a first common plane and the batten bar contacts the second panel along parallel lines in a second common plane.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with systems-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more elements. The terms "comprising," "including," and "having" are intended to be inclusive and mean that there may be additional elements other than the listed elements.

Embodiments of the present disclosure are directed toward a batten bar assembly for securing adjacent panels (e.g., for use in the assembly of dome roofs) of a structure. For example, the disclosed embodiments include a batten bar assembly that does not utilize bent, folded, or crimped panels. As a result, the costs and time associated with fabrication of parts (e.g., panels) and assembly of the structure (e.g., dome roof) may be reduced. Similarly, simplifying the design of parts of the assembly (e.g., beams, batten bars) may further reduce the cost and time to fabricate such parts. Additionally, present embodiments include a batten bar assembly that does not include fasteners driven through the panels held in place by the batten bar assembly. Thus, a screw chase of a structural member supporting the panels and the batten bar assembly (e.g., a beam or a strut) may be visible through a bolt hole of the batten bar during assembly of the panels and the batten bar assembly. Consequently, alignment of the batten bar assembly and the panels before securement of the fasteners to the batten bar and structural member screw chase may be simpler and may reduce the likelihood of a misaligned assembly. As discussed in detail below, the disclosed embodiments enable a reduction in the time and costs associated with part (e.g., panel, beams, batten bar) fabrication and structure (e.g., dome roof) assembly, as well as reduce the likelihood of errors during assembly.

Figure 1:
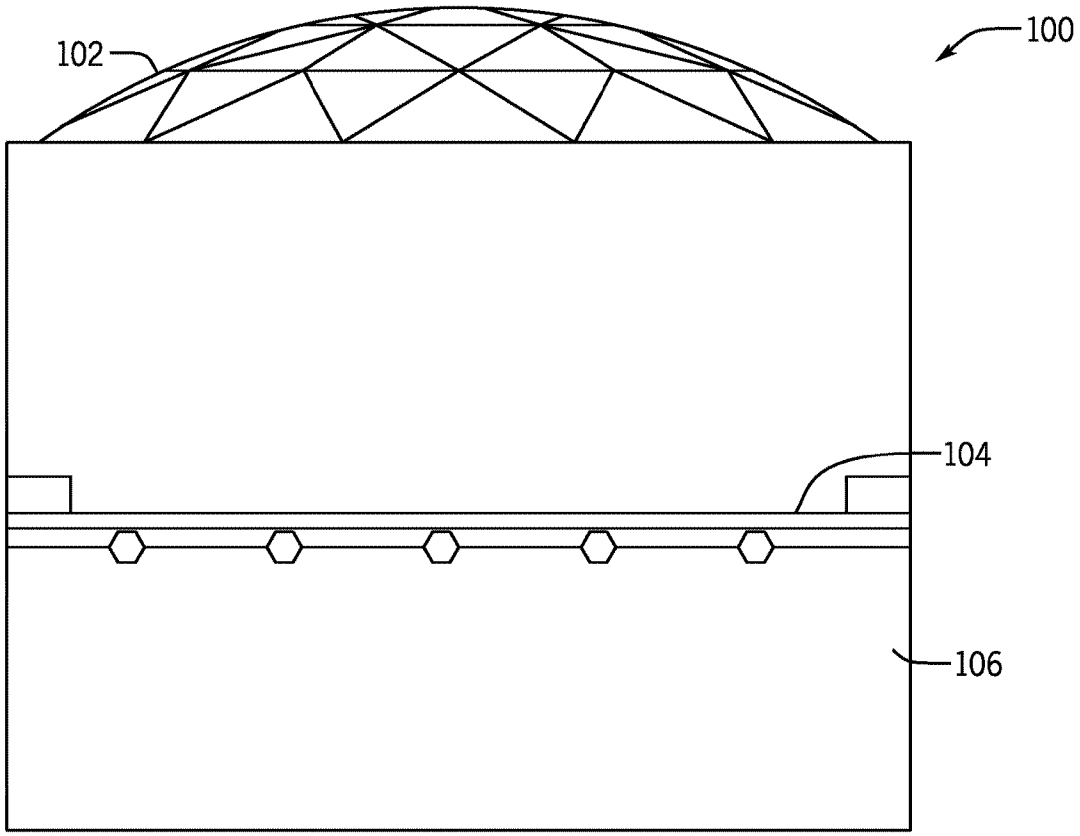
FIG. 1 is a schematic side view of a storage tank having a dome roof, in accordance with an embodiment of the present disclosure.

Referring now to FIG. 1, a side view of a storage tank 100 is shown. The storage tank 100 may be a cylindrical storage tank with a dome roof 102. Though the dome roof 102 is shown in FIG. 1, it should be understood that the disclosed techniques may be used in other applications to secure adjacent panels. In the illustrated embodiment, the storage tank 100 is equipped with an internal floating roof 104 and may contain some type of material or product 106. The product 106 may be hydrocarbons, synthetic chemicals, water, or any other type of substance capable of being stored in the storage tank 100. Moreover, the product 106 may be a gas, liquid, solid, or some combination thereof (hereinafter referred to generally as "fluid"). Additionally, the storage tank 100 may also include several additional components not pictured. For example, the storage tank 100 may have various pieces of instrumentation attached at various locations. The storage tank 100 may also have a spiral staircase or platform section at the top.

As described in detail below, the dome roof 102 may be formed from structural components supporting a plurality of panels. The panels may be held in place by batten bar assemblies that include a beam and a batten bar with one or more gaskets or seals that hold adjacent panels of the dome roof 102 in place. In particular, the batten bar assembly may hold the panels in place without bends or folds (e.g., pre-formed bends or folds) in the panel. Additionally, it should be appreciated that, while the following discussion describes batten bar assemblies used with the dome roof 102 of the storage tank 100, the present embodiments may be used in any application where a dome roof or other roofs could be utilized (e.g., homes, commercial buildings, etc.).

Figure 2:
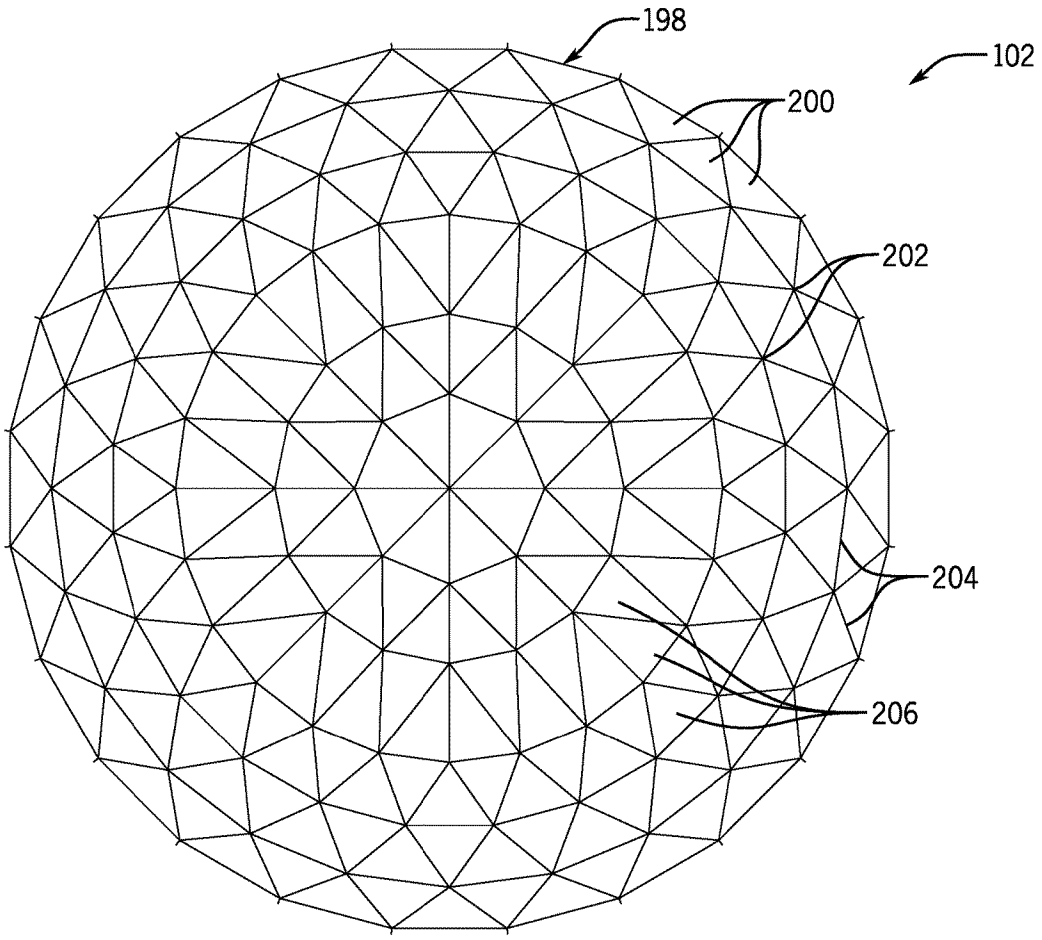
FIG. 2 is a schematic top view of a dome roof, in accordance with an embodiment of the present disclosure.

The dome roof 102 may be formed using various components. FIG. 2 is a top schematic view of the dome roof 102, illustrating the structural framework of the dome roof 102. As previously discussed, a dome roof is merely one possible application for the disclosed techniques. The disclosed techniques may be applied to any other application for holding adjacent panels in place. In the embodiment shown in FIG. 2, a frame 198 (e.g., structural framework) of the dome roof 102 is formed by coupling beams 204 (e.g., I-beams) at hubs or nodes 202 to form a plurality of adjacent geometric shapes or figures 206 that create the spherical segment or dome shape of the dome roof 102. As shown, the beams 204 can form a variety of different angles relative to adjacent beams 204 and the nodes 202. For example, if the node 202 has six beams 204 coupled to the node 202, each beam 204 may be spaced approximately sixty degrees apart from the center line of another adjacent beam 204. As such, the geometric figures 206 formed by the beams 204 may have varying shapes.

The frame 198 created by the nodes 202 and beams 204 provides the structural support for panels 200 positioned on top of the frame 198. The panels 200 may be made of a lightweight, corrosion resistant metal (e.g., aluminum, stainless steel, etc.) or other material depending on design conditions. The shape of each of the panels 200 corresponds to one of the geometric figures 206 created by the frame 198. The panels 200 overlay the nodes 202 and beams 204 and may be rigidly coupled to the beams 204. Depending on the shape of the panels 200, one or more panels 200 may be simultaneously coupled to several nodes 202. Multiple panels 200 may also be coupled to common beams 204. In other words, adjacent panels 200 may be secured to the common beam 204. For example, adjacent panels 200 may be secured to the common beam 204 by a batten bar. In this manner, the panels 200 may be secured and held in place to form the dome roof 102.

Figure 3:
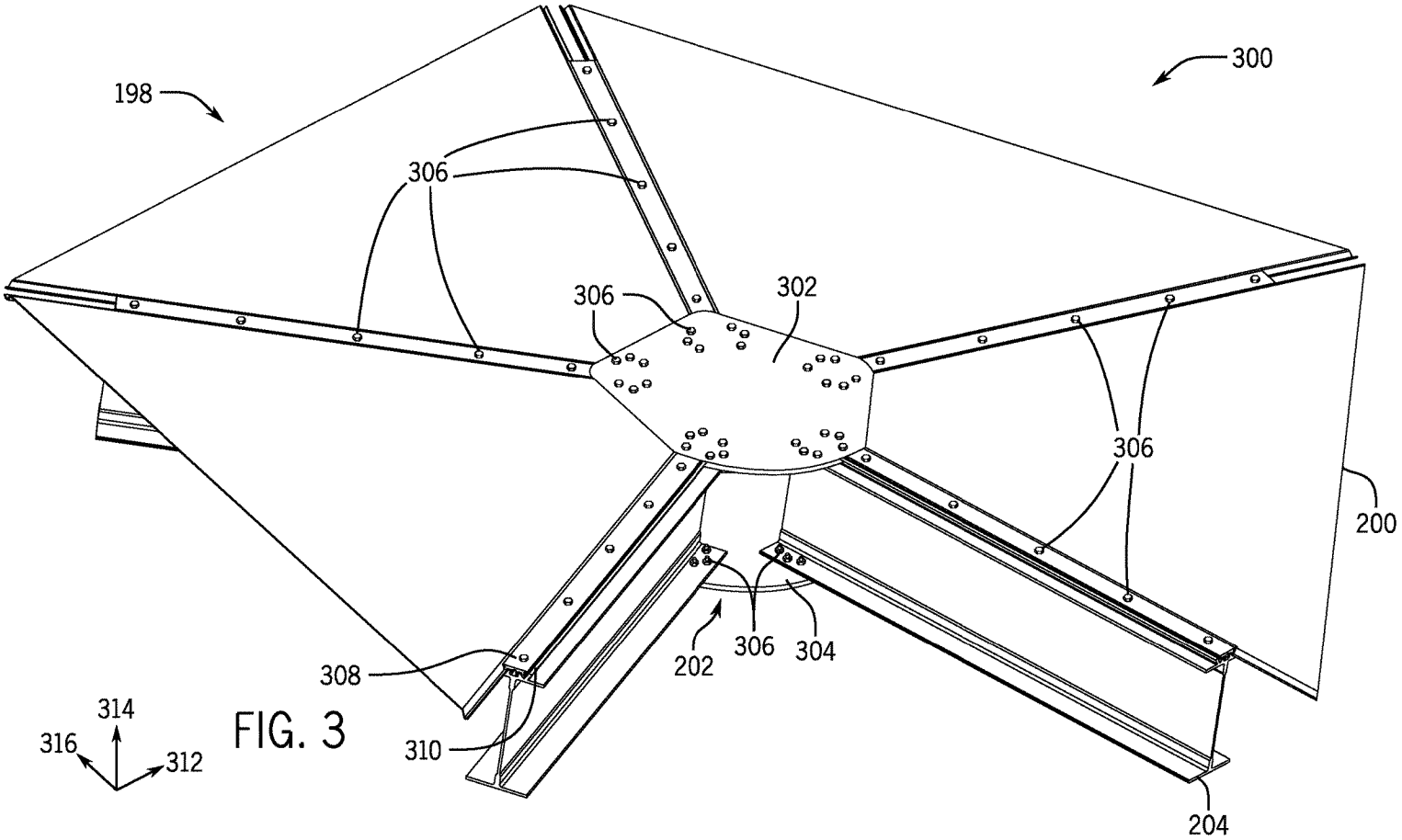
FIG. 3 is a top perspective view of a single node assembly of a dome roof, in accordance with an embodiment of the present disclosure.

The frame 198 of the dome roof 102 may include node assemblies formed by panels 200, nodes 202, and beams 204. For example, FIG. 3 is a top perspective view of a node assembly 300 of the frame 198. One panel 200 of the node assembly 300 is removed to better illustrate the assembly of the frame 198. A plurality of node assemblies 300 may form the frame 198 of the dome roof 102. The node assembly 300 includes the node 202 and the beams 204 coupled to the node 202. The node 202 has a top hub 302 and a bottom hub 304. Each of the beams 204 is rigidly coupled to both the top and bottoms hubs 302 and 304 with fasteners 306 (e.g., bolts, screws, pins, etc.). Each beam 204 may be further coupled to additional nodes 202. That is, the opposite ends of each of the beams 204 (not shown) may also be coupled to respective top and bottom hubs 302 and 304 of another node 202.

The top hub 302 and the beams 204 are configured to engage with and support the panels 200. In certain embodiments, each of the panels 200 in the node assembly 300 partially overlaps the top hub 302. Each panel 200 may further engage with two or more beams 204. The panels 200 are coupled to the beams 204 by batten bars 308. For example, one batten bar 308 may secure two panels 200 to one beam 204. Seals 310 (e.g. gaskets) between the batten bars 308 and the panels 200 create a fluid-tight barrier between the batten bar 308 and the panels 200. For clarity, a coordinate system is shown in FIG. 3. The beam 204 has a length that extends in an axial direction 316. The beam 204 also has a width that extends in horizontal direction 312 and a height that extends in vertical direction 314.

As discussed in detail below, one or more fasteners 306 extend through the batten bar 308 and engage with the beam 204 to couple the panels 200, beams 204, batten bar 308, and seals 310 together. In certain embodiments, the batten bar 308 may couple the beam 204 to the panels 200 along the perimeter of the panel 200. Moreover, the batten bar 308 compresses the seals 310 against the panels 200 to create a substantially fluid-tight barrier to reduce leakage or fluid ingress along the panels 200. The disclosed techniques may be used to hold the panels 200 in place without the need for folds, bends, or crimping along the edges of the panel 200. As will be appreciated, the disclosed batten bar assembly configuration may reduce the cost and time of constructing a dome roof 102, or other structure with adjacent panels, while also reducing the likelihood of assembly errors.

Figure 4:
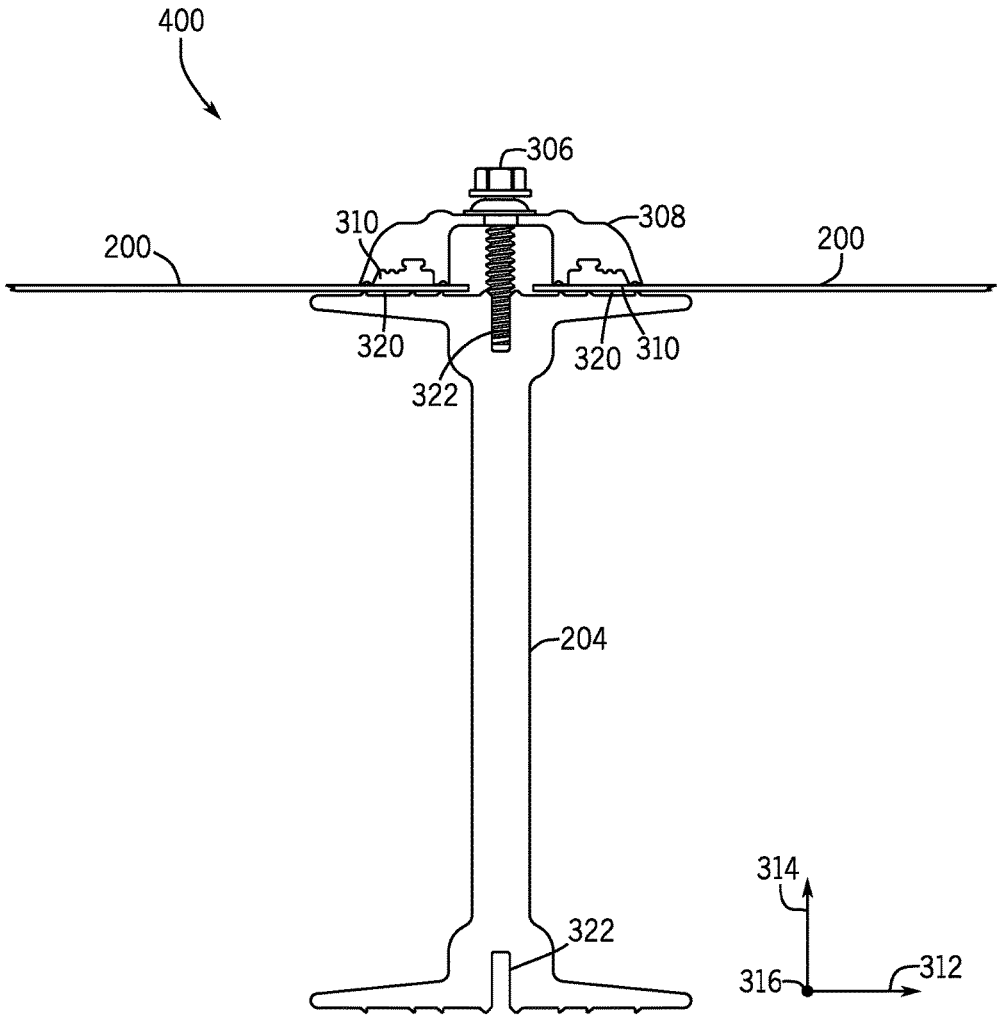
FIG. 4 is a cross-sectional side view of a batten bar assembly, in accordance with an embodiment of the present disclosure.

The batten bar 308, panels 200, beam 204, seals 310, and fasteners 306 couple together to form a batten bar assembly. For example, FIG. 4 is a cross-sectional view of an embodiment of a batten bar assembly 400. The batten bar assembly 400 is formed by coupling at least one panel 200 to the beam 204 using the batten bar 308, the seal 310, and the fastener 306. As shown in FIG. 4, the substantially flat (e.g., planar) panels 200 may be held in place without the need for bent, folded, or crimped edges. As mentioned above, the batten bar 308 may be coupled to the beam 204 using one or more fasteners 306 that thread into the beam 204 (e.g., a self-tapping screw). Because the fastener 306 is not driven through either of the panels 200, a screw chase 322 in the beam may be visible through the batten bar to ensure properly aligned assembly. When the fastener 306 is tightened, it may compress the seals 310 and secure the panels 200 in place between the batten bar 308 and the beam 204. The compression of the seals 310 may further create substantially fluid-tight sealing interfaces between the batten bar 308 and the panels 200. In certain embodiments, the seal 310 may be an engineered material that has a resistive force when compressed. The seals 310 may further run the length of the batten bar 308.

As previously mentioned, one or more panels 200 may frictionally engage with the beam 204, the batten bar 308, and/or the seals 310. Specifically, the panel 200 includes a flat edge or perimeter 320 (e.g., a panel without a bent or crimped edge or perimeter) that is placed on the top or bottom surface of the beam 204. The batten bar 308 and seals 310 are placed over the panel 200, and one or more fasteners 306 are installed through the batten bar 308. To this end, the batten bar 308 may include holes or apertures through which the fasteners 306 may extend. With the fasteners 306 extending through the batten bar 308, the threads of the fastener 306 may engage with the beam 204 (e.g., with a screw chase 322 of the beam 204). As the fastener 306 is tightened within the screw chase 322 of the beam 204, the beam 204 and the batten bar 308 and/or the seals 310 frictionally engage with the panel 200 to hold the panel 200 in place.

Figure 5:
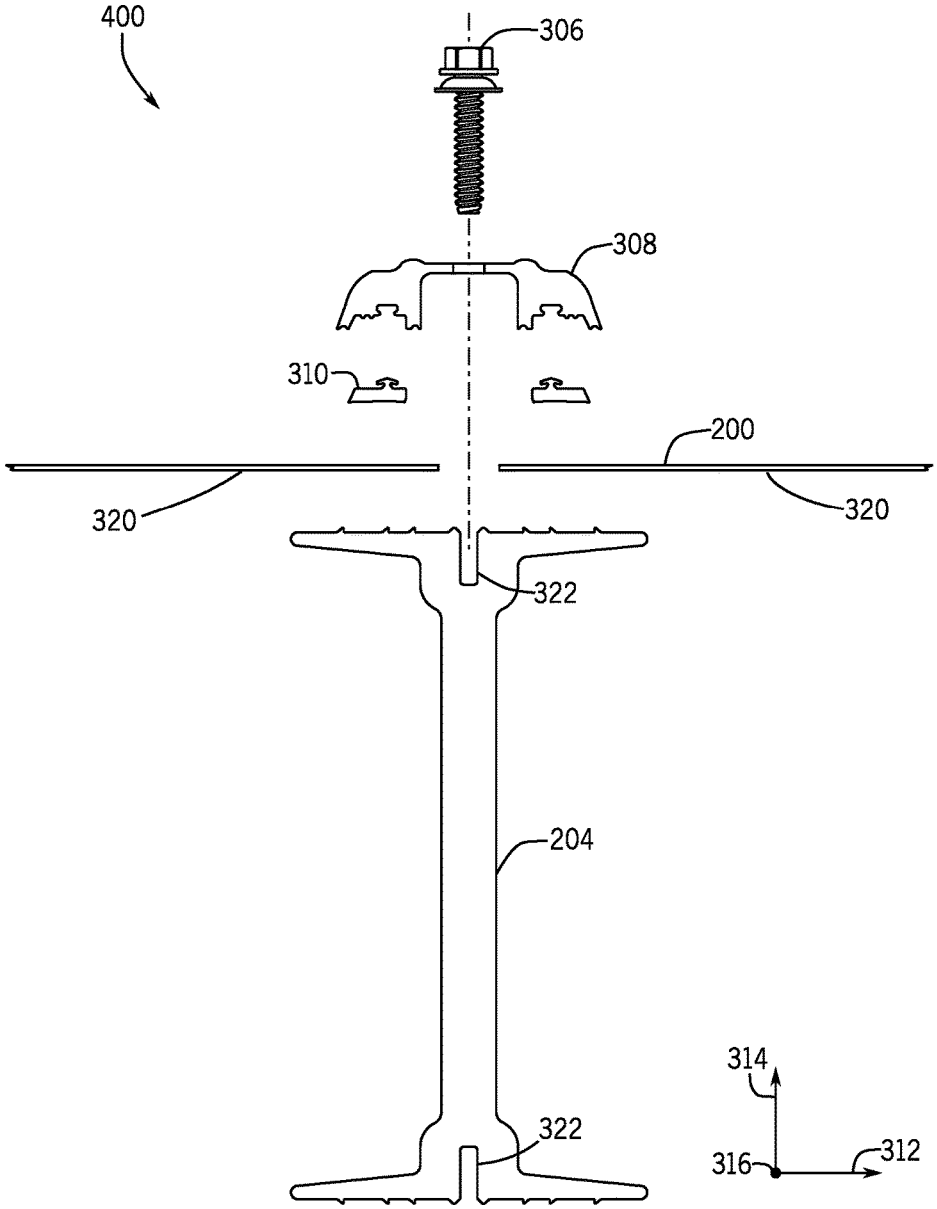
FIG. 5 is an exploded cross-sectional side view of a batten bar assembly, in accordance with an embodiment of the present disclosure.

An exploded cross-sectional side view of a batten assembly 400, in accordance with an embodiment of the present disclosure, is shown in FIG. 5. As was shown and described above with regard to FIG. 4, one or more panels 200 rest on the top or bottom surface of the beam 204. The batten bar 308 with seals 310 is placed over the panels 200, and fasteners 306 are inserted through the batten bar 308 to engage with the beam 204 (e.g., engage with the screw chase 322 of the beam 204). As the fasteners 306 are tightened, the panels 200 frictionally engage with the top or bottom surface of the beam 204, the batten bar 308, and/or the seals 310.

Figure 6:
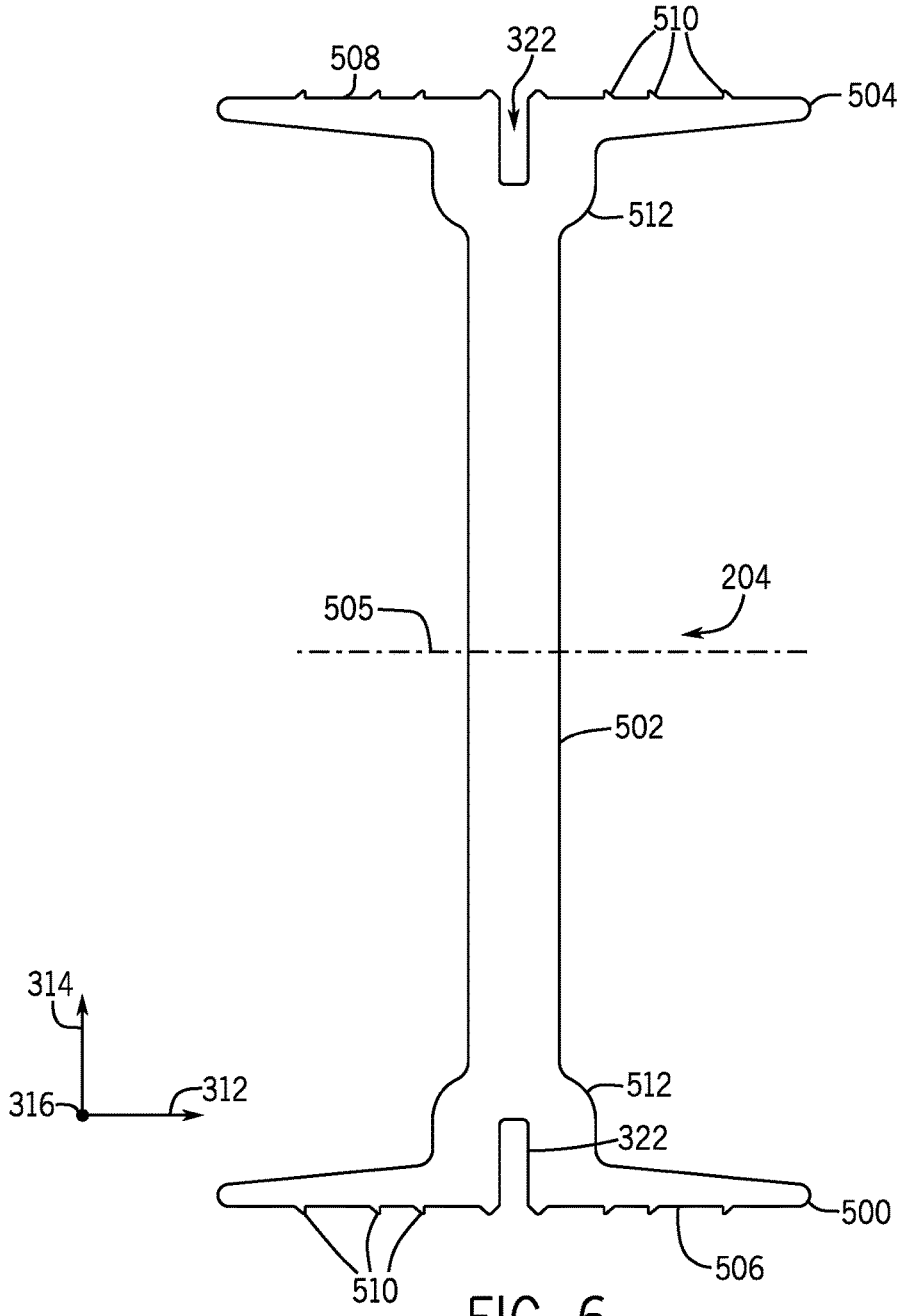
FIG. 6 is a cross-sectional side view of a beam, in accordance with an embodiment of the present disclosure.

The beam 204 includes various features to enable retention of the batten bar 308 and the panels 200 once the batten bar 308 is installed. For example, FIG. 6 is a cross sectional view of one embodiment of the beam 204, illustrating features of the beam 204 that enable retention of the batten bar 308 and the panels 200. As discussed above, the beam 204 is part of the frame 198 of the dome roof 102. The beam 204 may be made of metal (e.g., carbon steel, stainless steel, aluminum, other metal alloys, etc.) or other durable material (e.g., polymers, composites, etc.). The beam 204 is configured to support at least one panel 200 and to also receive and engage with the batten bar 308 via fasteners 306. The beam 204 has a base 500, a center structure 502, and a head 504. The beam 204 may be generally shaped like an I-beam. The beam 204 shown in FIG. 6 is symmetrical about a horizontal plane 505 of the beam 204, which extends in the axial direction 316 and in the horizontal direction 312. In some embodiments, the beam 204 may also be symmetrical about a vertical plane extending in the axial direction 316 and in the vertical direction 314. The symmetry of the beam 204 may reduce manufacturing costs and reduce scrap during fabrication and/or assembly of the dome roof 102. However, in other embodiments, the beam 204 may have another suitable shape or configuration. The base 500 of the beam 204 is configured to rigidly couple to the bottom hub 304 of the node 202, and the head 504 rigidly couples to the top hub 302 of the node 202. For example, the base 500 and head 504 may be coupled to the node 202 using the fasteners 306 discussed above.

The beam 204 may include a bottom surface 506 on the base 500 and a top surface 508 on the head 504. The top surface 508 and the bottom surface 506 may be substantially flat in direction 312, such that when the one or more panels 200 are installed, the flat edges 320 of the panels 200 rest flush on the top surface 508 and/or the bottom surface 506. In some embodiments, the top surface 508 and/or the bottom surface 506 may include teeth 510 or other texturing/surface treatment in order to enhance the frictional engagement between the beam 204 and the panels 200. The center structure 502 provides an offset distance between the top hub 302 of the node 202 and the bottom hub 304 of the node 202. The beam 204 may include a slot (e.g., screw chase 322). The screw chase 322 may be tapped or untapped. As mentioned above, the screw chase 322 may enable the use of traditional fasteners 306 (e.g. bolts or screws) for certain applications, such as the installation of the batten bar 308 or a hub cap.

The screw chase 322 is an opening in the head 504 of the base 500 of the beam 204 that may extend into the center structure 502 of the beam 204. In some embodiments, the center structure 502 of the beam 204 may have a section of increased thickness 512 in order to support the screw chase 322. Fasteners 306 may be installed through the batten bar 308 and may be retained within the screw chase 322 for securing the batten bar 308 to the beam 204. Additionally, fasteners 306 may be installed through the batten bar 308 and into the screw chase 322 to couple another component to the batten bar 308 and the beam 204. For example, a hub cover seat may be retained by a fastener extending through the batten bar 308 engaged with the screw chase 322. In one embodiment, fasteners 306 extending through the batten bar 308 and engaged with the screw chase 322 may be used in locations that are isolated from the environment surrounding the storage tank 100, such as underneath a hub cap of the storage tank 100. In such an embodiment, the use of fasteners 306 exposed to the environment surrounding the storage tank 100 may be reduced. In embodiments in which panels 200 are only coupled to one side of the beam 204 (e.g., the base 500 or the head 504), the screw chase 322 on the opposite end may be used to attach miscellaneous components or fixtures within the storage tank 100.

Figure 7:
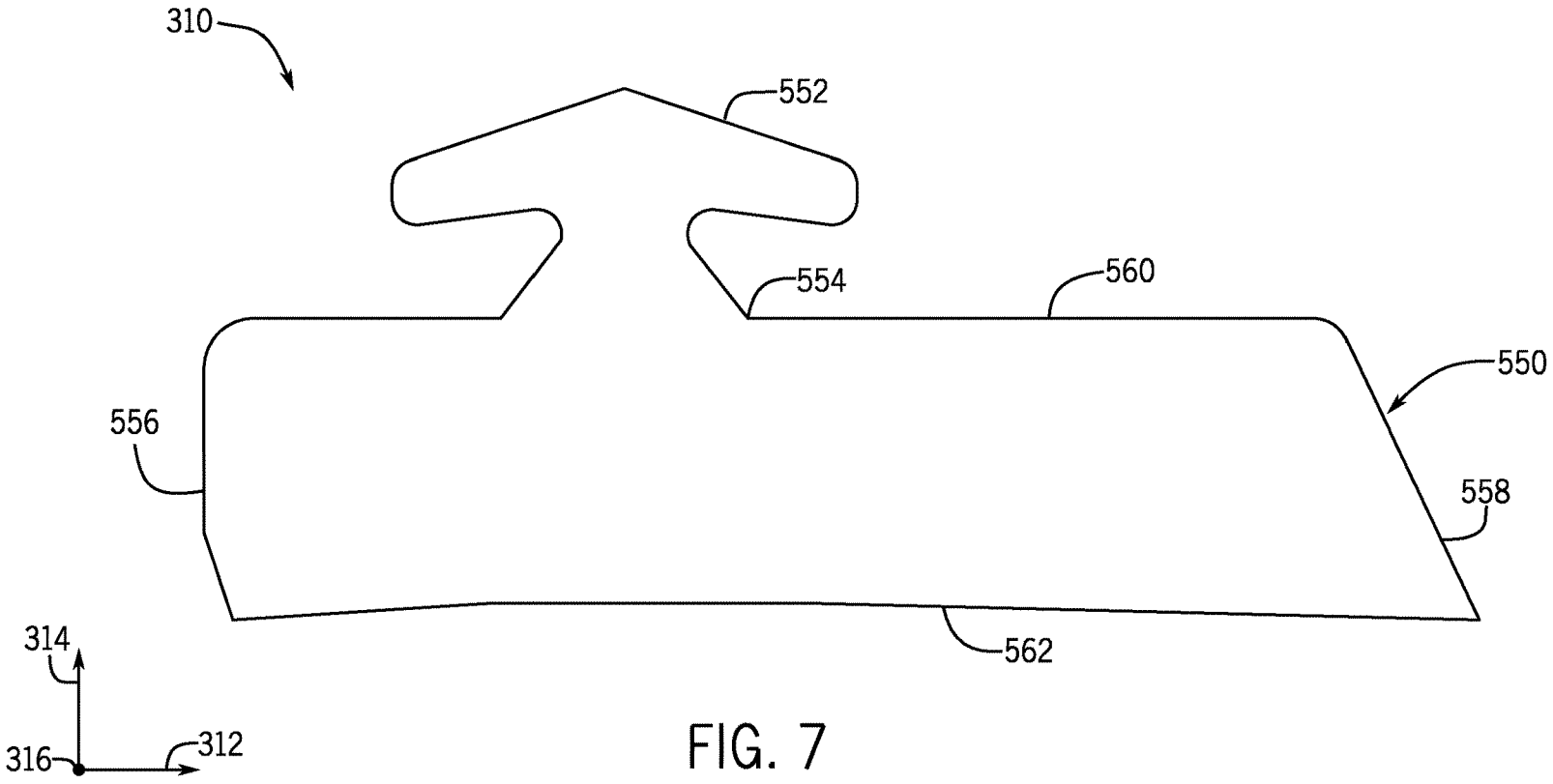
FIG. 7 is a cross-sectional side view of a seal, in accordance with an embodiment of the present disclosure.

The seal 310 includes various features to enable retention of the seal 310 by the batten bar 308 and/or enable the sealing engagement between the batten bar 308 and the panels 200 once the batten bar assembly 400 is installed. For example, FIG. 7 is a cross sectional view of one embodiment of the seal 310, illustrating features of the seal 310 that enable retention of seal 310 by the batten bar 308 and/or enable the sealing engagement between the batten bar 308 and the panels 200. The projection of the seal 310 may extend substantially uniformly in direction 316. Each seal 310 may include a seal body 550 and a seal protrusion 552, connected by a stem 554. The seal body 550 may have a substantially rectangular, trapezoidal, or hybrid (e.g., one vertical side surface 556 and one tapered side surface 558) in shape. The stem 554 may extend from a top surface 560 of the body 550. The sides of the stem 554 may be vertical surfaces, tapered surfaces, or a combination thereof. The seal protrusion 552 may be configured to couple to respective recesses (e.g., seal recesses) in the batten bar 308. In one embodiment, the seal protrusion 552 may have an umbrella-shaped projection, as shown in FIG. 7. However, in other embodiments the seal protrusion 552 projection may be different shapes. For example, the projection may be elliptical, circular, triangular, rectangular, pentagonal, or any other geometric shape. The stem 554 may also be narrower than the projection, such that the batten bar 308 can retain the seal 310 (e.g., within a seal recess of the batten bar 308). A bottom surface 562 of the seal 310 frictionally engages with a panel 200. The seal 310 may be made of a resilient material such as silicone, neoprene, another polymer, or any other resilient material.

Figure 8:
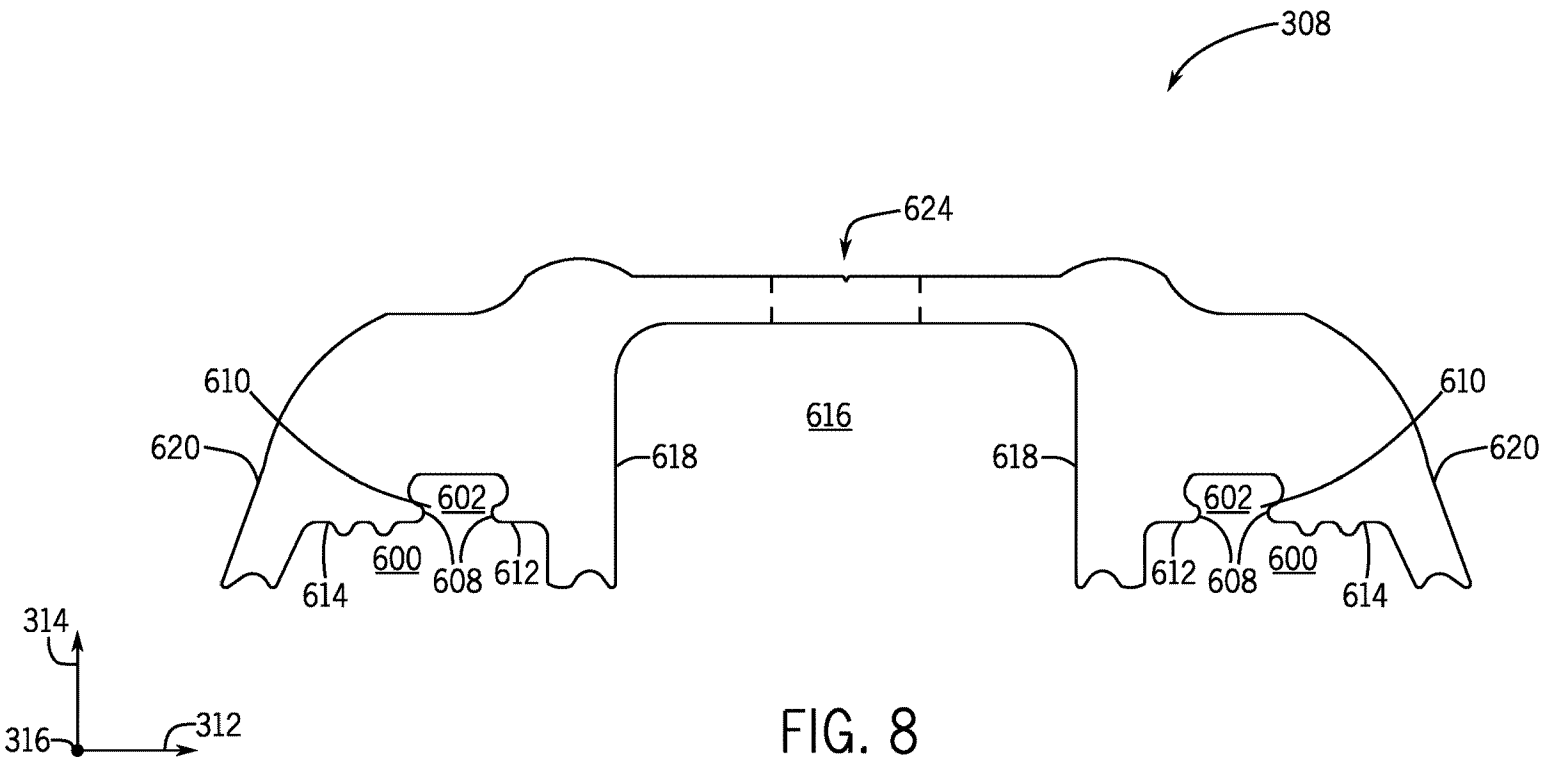
FIG. 8 is a cross-sectional side view of a batten bar, in accordance with an embodiment of the present disclosure.

The batten bar 308 also includes features to enable retention of the seals 310 and securement of the batten bar 308 to the beam 204. FIG. 8 is a cross-sectional axial view of one embodiment of the batten bar 308. The projection of the batten bar 308 shown in FIG. 8 may extend substantially uniformly in direction 316. As previously mentioned, the batten bar 308 is configured to secure the panels 200 to the beam 204. The batten bar 308 may engage with both the seal 310 and the panel 200 to compresses the seal 310 against the panel 200, creating a frictional engagement between the panel 200, the beam 204, the batten bar 308, and/or the seal 310. Because the seal 310 may be a resilient material, it may apply force to the batten bar 308 and the panel 200 simultaneously. However, because the batten bar 308 is secured to the beam 204 via fasteners 306, the batten bar 308 is able to resist the force of the seal 310 and thereby enable a pressure containing, substantially fluid-tight barrier between the batten bar 308, the panel 200, and the beam 204.

As previously described, the seals 310 are coupled to the batten bar 308. The batten bar 308 receives the seals 310 in respective seal recesses 600. The seal recesses 600 are configured to receive the protrusion 552 of each seal 310 in a protrusion recess 602. As previously discussed, the seal protrusion 552 may have an umbrella-shaped projection extending from the stem 554 of the seal 310. However, in other embodiments the seal protrusion 552 and/or the projection may have different shapes or geometries. The protrusion 552 engages with edges 608 of the seal protrusion recess 602, which substantially align with the stem 554 to secure the protrusion 552 within the seal protrusion recess 602. Retention of the protrusion 552 within the seal protrusion recess 602 enables retention of the seal 310 within the seal recess 600. The seal recess edges 608 are further shaped to create an opening 610 that is approximately the width of the stem 554, but narrower than the seal protrusion 552 or body 550.

In some embodiments, the seal recess 600 may as tall as, or slightly shorter than, the seal body 550 in direction 314 such that in an installed configuration the batten bar 308 shields the compressed seal 310 from sunlight or other elements. Thus, the disclosed batten bar 308 and seal 310 design shields the seal 310 from sunlight and other environmental elements, which may extend the usable life of the seal 310 and/or the quality of the sealing interface between the seal 310 and the panel 200.

The seal 310 may be inserted into the seal recess 600 of the batten bar 308 by sliding the seal 310 into the seal recess 600 axially (e.g., direction 316) along the length of the batten bar 308. The seal 310 may remain in place until removed in the same manner it was inserted (i.e., sliding axially along the length of the batten bar 308). In other embodiments, the seal 310 may be pressed or "snapped" into the seal recess 600 (e.g., in direction 314) and removed from the seal recess 600 by pulling the seal 310 out of the seal recess 600 (e.g., in a direction opposite direction 314).

The seal 310 may be a gasket that compresses when the fastener 306 is tightened. In one embodiment, the seal 310 is a resilient material and may apply a spring force on the batten bar 308 and panel 200 when the batten bar 308 is installed and engaged with the beam 204 via fasteners 306. However, the seal 310 may be made from any type of material that may create a sealing interface between the seal 310 and the panel 200 to reduce leakage, contain pressure, and/or reduce contamination of the product 106 within the storage tank 100. For example, the seal 310 may be made of metals, rubbers, plastics, corks, foams, composite substances, or a combination thereof. For example, the seal 310 may be an elastomer (e.g., nitrile).

As shown in FIG. 8, the batten bar 308 may also have an inside seal contact edge 612 (e.g., radially inward edge) and an outside seal contact edge 614 (e.g., radially outward edge). The inside seal contact edge 612 and outside seal contact edge 614 may be substantially smooth or may have texture (e.g., teeth, ribs, knurling, etc.) in order to increase friction between the batten bar 308 and the seal 310. The seal contact edges 612 and 614 may be configured to retain the seal 310 and/or apply a force (e.g., a distributed force) to the seal 310. The force applied by the seal contact edges 612 and 614 during installation of the batten bar assembly 400 compresses the seal 310 against the panel 200. Because the batten bar 308 is secured to the beam 204 by fasteners 306, which enable compression of the seal 310 when tightened, a sealing interface is formed between the seal 310 and the panel 200 that may block exposure of the interior of the storage tank 100 to the surrounding environment.

The batten bar 308 may also have a central channel 616 disposed between the seal recesses 600. In one embodiment, the central channel 616 runs the length of the batten bar 308. In the embodiment shown in FIG. 8, the central channel 616 is taller in direction 314 than the seal recesses 600. In other embodiments, the central channel 616 may be the same height as the seal recesses 600 or shorter than the seal recesses 600 in direction 314. Similarly, though the central channel 616 shown in FIG. 8 is wider than the seal recesses 600, in other embodiments, the central channel may be the same width or narrower than the seal recesses 600 in direction 312.

The batten bar 308 also includes inner legs 618 and outer legs 620. The inner legs 618 separate the central channel 616 from the seal recesses 600. The outer legs 620 act as an enclosing or perimeter structure for the seal recesses 600 and the batten bar 308. The inner and outer legs 618, 620 may or may not contact the panel 200 when the batten bar 308 is installed. Accordingly, the bottom surface of each leg 618, 620 may be smooth and flat or may be textured to increase friction between the panel 200 and the batten bar 308.

The batten bar 308 also includes a plurality of apertures 624 formed in the top of the batten bar 308 and arrayed along the length of the batten bar 308. The apertures 624 may be positioned such that respective fasteners 306 may be inserted through the apertures 624, pass through the central channel 616, and engage with the beam 204. It should be noted that, using the disclosed batten bar assembly 400 design, the fastener 306 need not be driven through one or both panels 200 in order to install the batten bar assembly 400 and hold the panels 200 in place. As a result, assembly of the batten bar assembly 400 against the panels 200 may be simplified and improved.

As the batten bar 308 functions to couple the panels 200 to beams 204, a durable, strong material may be used to form the batten bar 308 to ensure the structural integrity of the dome roof 102 or other multi-panel assembly. The batten bar 308 may be constructed from any suitable material known in the art. For example, in one embodiment, the batten bar 308 is made of aluminum. The batten bar 308 may be made of other corrosion resistant material (e.g., stainless steel, other alloys, polymers, etc.), as the batten bar 308 may be exposed to environmental elements. Furthermore, in certain embodiments, the batten bar 308 may have a single piece construction (e.g., a one-piece configuration) and may be cast, machined, or extruded.

As mentioned above, the seals 310 engage both the batten bar 308 and the panels 200. The seal 310 is further configured to conform to the panel 200 on a bottom surface 562 of the seal 310 and to the batten bar 308 on a top surface 560 of the seal 310. As mentioned above, the seal 310 includes the seal protrusion 552 that engages with the seal protrusion recess edge 608 of the seal protrusion recess 602. The seal protrusion 552 serves to couple the seal 310 to the batten bar 308. An outside section 558 of the seal 310 may be covered by the batten bar 308 (e.g., outside surface 558 of seal recesses 600 of the batten bar 308) so that the seal 310 is not exposed to ultraviolet light from the sun or other environmental elements. In one embodiment, the outside section 558 is in contact with the outside leg 620 of the batten bar 308.

Figure 9:
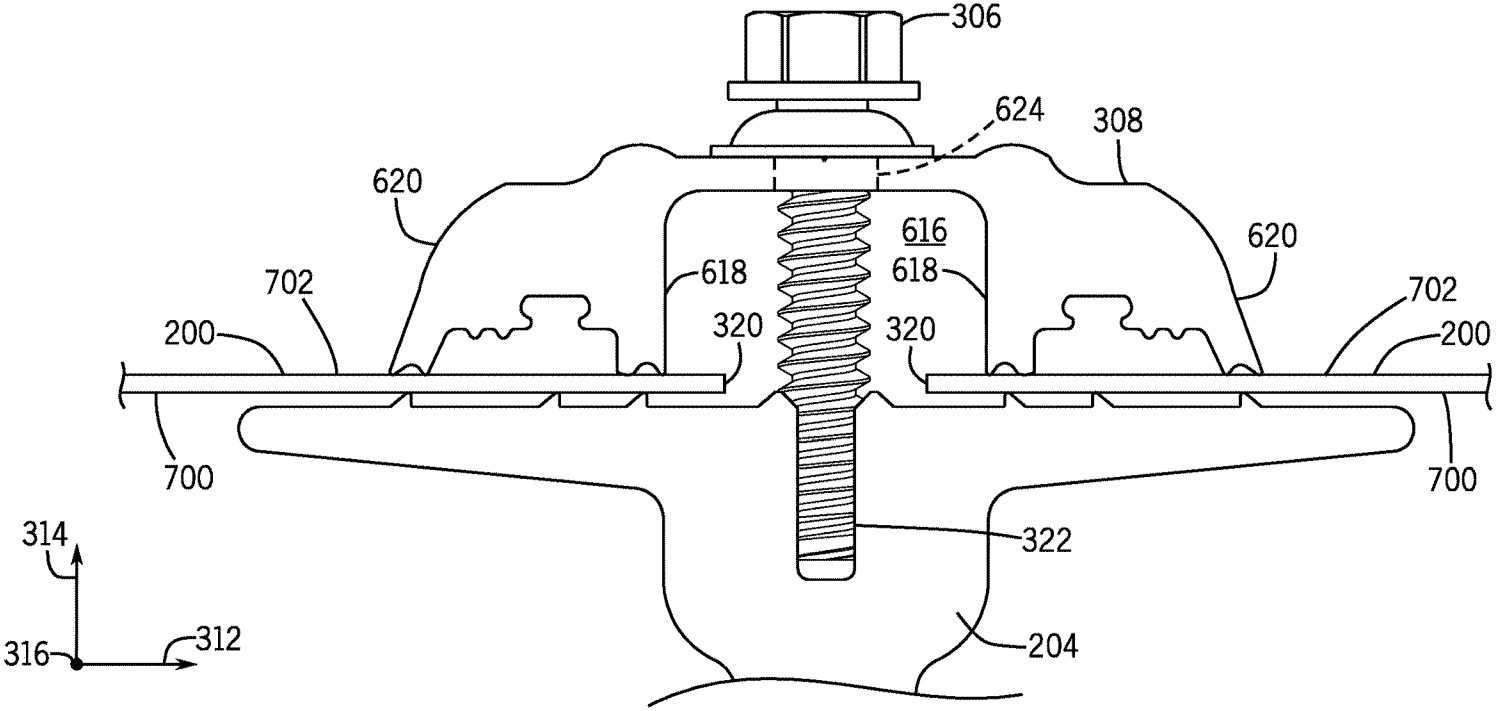
FIG. 9 is a cross-sectional side view of a batten bar assembly, in accordance with an embodiment of the present disclosure.

As mentioned above, the batten bar 308 retains adjacent panels 200 against the beam 204. For example, FIG. 9 is a partial cross-sectional axial view of the batten bar 308 installed against the beam 204 and retaining panels 200. In the present embodiment, adjacent substantially planar panels 200 (e.g., the perimeters 320 of the panels 200 have not been bent, crimped, or folded) are laid on the top surface 508 of the beam 204 such that the bottom surfaces 700 of the panels 200 are substantially flush with the top surface 508 of the beam 504. The panels 200 are positioned such that the perimeters 320 of the panels 200 do not overlap. Indeed, the panels 200 are separated by a small gap, exposing the screw chase 322 in the beam 204, allowing the screw chase to be seen through the apertures 624, ensuring improved alignment during assembly. The seals 310 may be installed by aligning the seal protrusion 552 with the protrusion recess 602, and then inserting the seal 310 into the batten bar 308. The batten bar 308 is positioned such that the apertures 624 align with the screw chase 322 of the beam 204. The batten bar includes first and second inside legs 618 that define a central channel, 616, and first and second outside legs 620 that in an installed configuration extend around first and second seals 310, shielding the seals 310 from sunlight or other elements. One of the inside legs 618 and one of the outside legs 620 are positioned over the first panel 200, while the second inside leg 618 and second outside leg 620 are positioned over the second adjacent panel 200. Fasteners 306 are inserted through the apertures 624 in the batten bar 308. Threads on the exterior of the fasteners 306 engage with the screw chase 322 in the beam 204. As the fasteners 306 are tightened, the legs 618, 620 of the batten bar 308 come into contact with the top surfaces 702 of the panels 200 in a single plane, which is substantially coplanar with the top surfaces 702 of the panels 200. In other words, when the batten bar 308 is installed, the batten bar 308 may contact one panel 200 along two parallel lines (e.g., inside leg 618 and outside leg 620) in a first common plane. Correspondingly, the batten bar 308 may contact the second panel 200 along two parallel lines (e.g., inside leg 618 and outside leg 620) in a second common plane. However, in other embodiments, the seal 310 may not compress enough for the legs 618, 620 to contact the top surfaces 702 of the panels 200. In the position shown in FIG. 9, the panels 200 are blocked from moving in a lateral direction relative to the batten bar 308 due to the frictional engagement created between the panels 200, the beam 204, the batten bar 308, and/or the seals 310. Folds, bends, and/or crimps along the perimeter 320 of the panel 200 are not necessary to block lateral movement. That is, the panels 200 may be substantially flat or planar between outer edges of the respective panel. Similarly, the fasteners 306 need not be driven through the panels 200 to hold the panels 200 in place. Furthermore, movement of the panels 200 in the vertical direction is also blocked because the batten bar 308 and seal 310 are secured into place by engagement between the fasteners 306 and the beam 204. As discussed above, the seals 310 may create a fluid-tight sealing interface between the seals 310 and the panels 200 to reduce leakage from the storage tank 100 or contamination within the storage tank 100.

The batten bar assembly 400 configuration discussed above enables reduction in time and cost associated with part fabrication and assembly by simplifying part design and reducing tolerances for assembly. Furthermore, because the fasteners 306 are not driven through one or more panels 200, the beam screw chase 322 can be more readily located through the aperture 624 in the batten bar 308, thereby improving and simplifying alignment of the batten bar 308 and beam 204 during installation of the batten bar assembly 400.

Additionally, the symmetrical design of the beam 204 allows for the beam 204 to be flipped over (e.g., vertically) and used if the screw chase 322 is damaged during transport or assembly. As was shown and discussed with regard to FIG. 6, the beam 204 is symmetrical about a horizontal plane 505 such that the head 504 and the base 500 are substantially equivalent to one another. That is, the head 504 and the base 500 may both have screw chases 322. Accordingly, the top surface 508 and screw chase 322 of the head 504 are substantially equivalent to the bottom surface 506 and screw chase 322 of the base 500. Thus, the beam 204 may be installed with the bottom surface 506 facing downward and the top surface 508 facing upward (as shown in FIG. 6), or with the top surface 508 facing downward and the bottom surface 506 facing upward. If one of the screw chases 322 is damaged during transport or assembly, the beam can be installed or reinstalled (e.g., removed and rotated 180 degrees about plane 505) such that the undamaged screw chase 322 faces upward.

Figure 10:
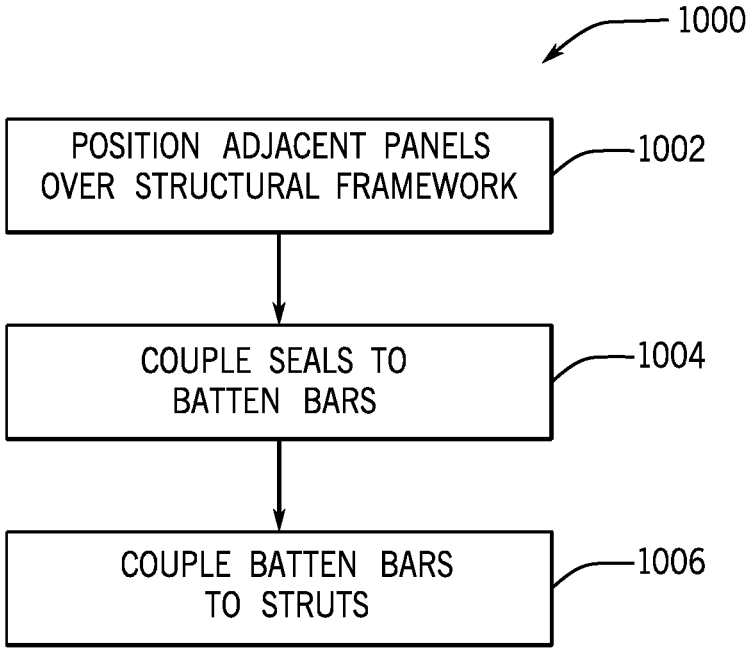
FIG. 10 is a flow chart of a method for installing a batten bar assembly, in accordance with an embodiment of the present disclosure.

As mentioned above, a multi-panel assembly (e.g., dome roof 102) is formed using batten bars 308 that are coupled to beams 204 via fasteners 306. A flow chart for a method 1000 of installing the dome roof 102 is shown in more detail in FIG. 10. First, at step 1002, the panels 200 are disposed over the structural framework 198 by aligning the panel 200 edges with respect to the screw chases 322 of the beams 204. Next, the seals 310 are coupled to the batten bars 308 at step 1004 by inserting seal protrusions 552 into seal protrusion recesses 602. At step 1006, the batten bars 308 are coupled to the beams 204. For example, batten bars 308 are positioned over the beams 204 such that the apertures 624 in the batten bars 308 align with the screw chases 322 in the beams 204. Fasteners 306 are then inserted through the apertures 624 in the batten bars 308. The threads of the fasteners 306 engage with the screw chases 322 of the beams 204. As the fasteners 306 are tightened, the seals 310 are compressed, forming a frictional engagement with the panel 200 that forms a sealing interface between the seal 310 and the panel 200, and also holds the panel 200 in place. The above steps may be repeated for installing as many panels 200 as desired.

By simplifying part design, time and costs associated with part fabrication and assembly may be reduced. Specifically, the use of flat panels 200 without bends, folds, or crimping near the edges 320 of the panels 200 reduces the cost of fabricating the panels. Similarly, a simplified and symmetric beam 204 design reduces the cost of producing the beam. Because the interfaces between the beam 204, the panels 200, and the batten bar 308 are simple, rather than intricate, part tolerances may be relaxed, resulting in less expensive parts and easier assembly. A gap between panels 200 allows the screw chase 322 of the beam 204 to be seen through the apertures 624 of the batten bar 308, ensuring proper alignment during assembly. Furthermore, overall increased ease of assembly, as well as the symmetrical design of the beam 204, which allows the beam to be flipped over and the second screw chase used if the first screw chase is damaged, furthered reduces the scrap associated with assembling a dome roof 102, or other batten assembly 400 for securing adjacent panels.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a beam comprising a head, the head comprising a top surface comprising one or more teeth, and a first slot formed in the top surface, wherein the first slot extends a length of the beam, wherein the beam comprises a single part;

first and second flat panels supported by the beam, wherein the first and second flat panels are substantially flat between outer edges of the respective panels;

a batten bar configured to secure the first and second panels to the beam, the batten bar comprising:

first and second inside legs that define a central channel;

a first outside leg, the first outside leg and the first inside leg defining a first seal recess configured to receive and retain a first seal;

a second outside leg, the second outside leg and the second inside leg defining a second seal recess configured to receive and retain a second seal; and a plurality of apertures disposed along a length of the batten bar;

the first seal disposed within the first seal recess; and the second seal disposed within the second seal recess, wherein the batten bar comprises a single piece, wherein, in an installed configuration, the first and second flat panels rest flush on the top surface of the beam, the batten bar and the first and second seals are disposed on top of the first and second panels such that the first inside leg and first outside leg directly contact the first panel along a first common plane, the second inside leg and second outside leg directly contact the second panel along a second common plane, and a plurality of fasteners extend through the plurality of apertures and engage with the slot to hold the first and second panels in place.

2. The system of claim 1, wherein the beam comprises a base disposed opposite the head, the base comprising a bottom surface and a second slot formed in the bottom surface.

3. The system of claim 1, wherein the beam comprises an I-beam.

4. The system of claim 1, wherein the beam comprises a cross-section that is symmetrical about a horizontal axis.

5. The system of claim 1, wherein each of the first and second seals comprises a seal body and a seal protrusion coupled to the seal body by a stem.

6. The system of claim 5, wherein the first and second seal recesses comprise respective first and second seal protrusion recesses, each comprising seal protrusion recess edges, wherein the seal protrusion recess edges interface with the stems of the first and second seals such that the first and second seal protrusion recesses receive and retain the first and second seals.

7. The system of claim 1, wherein the beam comprises:

a base comprising a bottom surface; and a center structure joining the head and the base;

wherein the beam is symmetrical about a horizontal axis.

8. The system of claim 1, wherein the fasteners comprise self-tapping screws.

9. A system, comprising:

a batten bar configured to secure first and second adjacent flat panels to a structural framework, wherein the batten bar comprises:

first and second inside legs that define a central channel;

a first outside leg, the first outside leg and the first inside leg defining a first seal recess configured to receive and retain a first seal, wherein the first outside leg comprises a first plurality of teeth configured to contact the first flat panel;

a second outside leg, the second outside leg and the second inside leg defining a second seal recess configured to receive and retain a second seal, wherein the second outside leg comprises a second plurality of teeth configured to contact the second flat panel; and a plurality of apertures disposed along the length of the batten bar;

wherein the batten bar comprises a single piece, and wherein, in an installed configuration, the first inside leg and the first outside leg are configured to contact the first flat panel along a first common plane, and the second inside leg and second outside leg contact the second panel along a second common plane.

10. The system of claim 9, wherein the first seal is coupled to the batten bar by a first seal protrusion retained in a first seal protrusion recess of the batten bar and the second seal is coupled to the batten bar by a second seal protrusion retained in a second seal protrusion recess of the batten bar.

11. The system of claim 10, wherein the first and second seal protrusion recesses each comprise seal protrusion recess edges configured to interface with first and second stems of the respective first and second seals, so as to retain the first and second seal protrusions in the respective first and second seal protrusion recesses of the batten bar.

12. The system of claim 9, wherein the batten bar comprises the first seal configured to engage with the first flat panel and the second seal configured to engage with the second flat panel.

13. The system of claim 9, wherein in an installed configuration, a plurality of fasteners extend through the plurality of apertures and engage with a screw chase of the structural framework to hold the first and second adjacent flat panels in place.

14. A storage tank comprising:

a cylindrical wall; and a dome roof comprising:

a plurality of beams, each beam comprising:

a first end;

a second end; and a head comprising a top surface and a first slot formed in the top surface wherein the first slot extends a length of the beam, wherein each beam comprises a single part;

a plurality of nodes coupling the first or second ends of adjacent beams of the plurality of beams to one another;

a plurality of panels, wherein each panel is disposed on the top surface of one or more of the plurality of beams such that each panel is supported by one or more beams of the plurality of beams along one or more outer edges of each of the plurality of panels, and wherein each of the plurality of panels is substantially flat between the outer edges of the panel;

a plurality of batten bars, each batten bar of the plurality of batten bars disposed on top of first and second adjacent panels of the plurality of panels, securing the first and second adjacent panels of the plurality of panels to one of the plurality of beams, wherein each batten bar of the plurality of batten bars comprises:

first and second inside legs that define a central channel;

a first outside leg comprising a first plurality of teeth configured to contact the first panel of the plurality of panels, the first outside leg and the first inside leg defining a first seal recess retaining a first seal disposed within the first seal recess, wherein the first inside leg and the first outside leg directly contact the first panel of the plurality of panels along a first common plane;

a second outside leg comprising a second plurality of teeth configured to contact the second panel of the plurality of panels, the second outside leg and the second inside leg defining a second seal recess retaining a second seal disposed within the second seal recess, wherein the second inside leg and the second outside leg directly contact the second panel of the plurality of panels along a second common plane; and a plurality of apertures disposed along a length of the batten bar;

wherein the batten bar comprises a single piece; and a plurality of fasteners extending through the plurality of apertures and engaging with the slots of each of the plurality of beams to hold each of the plurality of panels in place.

* * * * *